US008747168B2

(12) United States Patent
Kida

(10) Patent No.: US 8,747,168 B2
(45) Date of Patent: Jun. 10, 2014

(54) STACKING CONNECTOR

(75) Inventor: Shinjiro Kida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 220 days.

(21) Appl. No.: 13/405,671

(22) Filed: Feb. 27, 2012

(65) Prior Publication Data

US 2012/0225576 A1 Sep. 6, 2012

(30) Foreign Application Priority Data

Mar. 4, 2011 (JP) ..... 2011-048048

(51) Int. Cl.
*H01R 13/502* (2006.01)

(52) U.S. Cl.
USPC ..... 439/701; 439/752

(58) Field of Classification Search
USPC ..... 439/701, 752
See application file for complete search history.

(56) References Cited

U.S. PATENT DOCUMENTS

| | | | | |
|---|---|---|---|---|
| 4,707,043 | A * | 11/1987 | Reed | 439/142 |
| 4,753,614 | A | 6/1988 | Weiner | |
| 5,122,077 | A * | 6/1992 | Maejima et al. | 439/398 |
| 5,156,556 | A * | 10/1992 | Ma | 439/357 |
| 5,288,251 | A * | 2/1994 | Sumida | 439/701 |
| 5,320,555 | A * | 6/1994 | Okabe | 439/354 |
| 5,487,677 | A * | 1/1996 | Hoffner | 439/293 |
| 5,520,550 | A * | 5/1996 | Okabe | 439/404 |
| 5,895,296 | A * | 4/1999 | Okabe | 439/701 |
| 6,319,071 | B1 * | 11/2001 | Sato | 439/701 |
| 6,343,960 | B1 * | 2/2002 | Sato | 439/701 |
| 6,358,098 | B1 * | 3/2002 | Wakata | 439/701 |
| 6,361,355 | B1 * | 3/2002 | Matsuoka et al. | 439/488 |
| 6,361,374 | B1 * | 3/2002 | Lloyd et al. | 439/701 |
| 6,375,518 | B2 * | 4/2002 | Sato | 439/701 |
| 6,386,925 | B1 * | 5/2002 | Sato et al. | 439/701 |
| 6,461,201 | B1 * | 10/2002 | Maeda et al. | 439/701 |
| 6,478,632 | B2 * | 11/2002 | Tanaka | 439/752 |
| 6,551,119 | B1 * | 4/2003 | Sakamoto et al. | 439/287 |
| 6,573,453 | B2 * | 6/2003 | Takada et al. | 174/72 A |
| 6,666,729 | B2 * | 12/2003 | Takamura et al. | 439/723 |
| 6,802,746 | B2 * | 10/2004 | Carranza | 439/752 |
| 6,814,627 | B2 * | 11/2004 | Yamamoto et al. | 439/701 |
| 7,494,384 | B2 * | 2/2009 | Friedhof | 439/701 |
| 7,572,154 | B2 * | 8/2009 | Ichio et al. | 439/701 |
| 8,187,041 | B2 * | 5/2012 | Ito | 439/701 |
| 2009/0053937 | A1 * | 2/2009 | Tsou et al. | 439/638 |
| 2012/0225576 | A1 * | 9/2012 | Kida | 439/345 |

FOREIGN PATENT DOCUMENTS

| | | |
|---|---|---|
| FR | 2706688 | 12/1994 |

* cited by examiner

*Primary Examiner* — Neil Abrams
(74) *Attorney, Agent, or Firm* — Gerald E. Hespos; Michael J. Porco; Matthew T. Hespos

(57) ABSTRACT

Each housing (10) includes terminal accommodating chambers (12), a communication opening (14) formed in an outer surface and communicating with the terminal accommodating chambers (12), and projections (16) projecting from a terminal accommodating portion (11). With the housings (10) placed one above the other, the projections (16) inserted in the terminal accommodating chambers (12) through the communication opening (14) are engaged with terminal fittings (20) in the terminal accommodating chambers (12) to retain the terminal fittings (20). Receiving portions (13) are provided in each housing (10) and each projection (16) includes a lock (18) to be engaged with the corresponding receiving portion (13) to hold the housings (10) in an assembled state.

13 Claims, 11 Drawing Sheets

STACKING CONNECTOR

BACKGROUND OF THE INVENTION

1. Field of the Invention

The invention relates to a connector.

2. Description of the Related Art

U.S. Pat. No. 7,572,154 discloses a stacking connector formed by stacking a plurality of housings one above another. Each housing has terminal accommodating chambers and communication openings in outer surfaces of the housings communicate with the terminal accommodating chambers. Projections are formed on outer surfaces of the housings opposite the communication openings. The projections of one housing pass through the communication openings and into the terminal accommodating chambers of an adjacent housing to retain terminal fittings in the terminal accommodating chambers when housings are stacked.

The stacked housings are inserted into a fitting recess of a joint connector to hold the housings in a stacked state. The stacked housings are separated easily prior to insertion in the fitting recess. Thus, an operator must manually hold the housings in the stacked state prior to insertion into the fitting recess. Therefore, there is a demand for an improvement in operational efficiency.

The present invention was completed in view of the above situation and an object thereof is to improve operational efficiency.

SUMMARY OF THE INVENTION

The invention relates to a connector with a first member that has at least one terminal accommodating chamber. At least one communication opening is formed in an outer surface of the first member and communicates with the terminal accommodating chamber. The connector also includes a second member with a base and at least one projection projecting from the base. The base of the second member can be placed on the outer surface of the first member. As a result, the projection is inserted through the communication opening and into in the terminal accommodating chamber to engage a terminal fitting in the terminal accommodating chamber and to retain the terminal fitting. The projection includes at least one lock for engaging a receiving portion to hold the first and second members in an assembled state. Thus, an operator need not hold the assembled members by the hand to keep the members from separating, operational efficiency is excellent.

The first and second members preferably are identical housings, each of which includes the terminal accommodating chamber, the communication opening, the projection, the receiving portion and the lock. The housings can be stacked.

The projection interferes with a terminal fitting that has not been inserted properly into the terminal accommodating chamber. Thus, the assembling of the first and second members is incomplete and a clearance is formed between the first and second members and is open in a direction crossing an assembling direction. On the other hand, a surface of the first member and a facing surface of the second member are held in surface contact when the first and second members are assembled properly.

A detection jig can be inserted into the clearance between the two members when the assembling of the first and second members is incomplete. Thus, the assembled state of the two members can be detected based on whether the detection jig can be inserted into the clearance.

A portion of an improperly inserted terminal fitting preferably is in an entrance path for the projection.

A plurality of housings and a retainer may be stacked in a stacking direction as the first and second members.

These and other objects, features and advantages of the present invention will become more apparent upon reading of the following detailed description of preferred embodiments and accompanying drawings.

BRIEF DESCRIPTION OF THE PREFERRED EMBODIMENTS

DETAILED DESCRIPTION OF THE PREFERRED EMBODIMENTS

Figure 1:
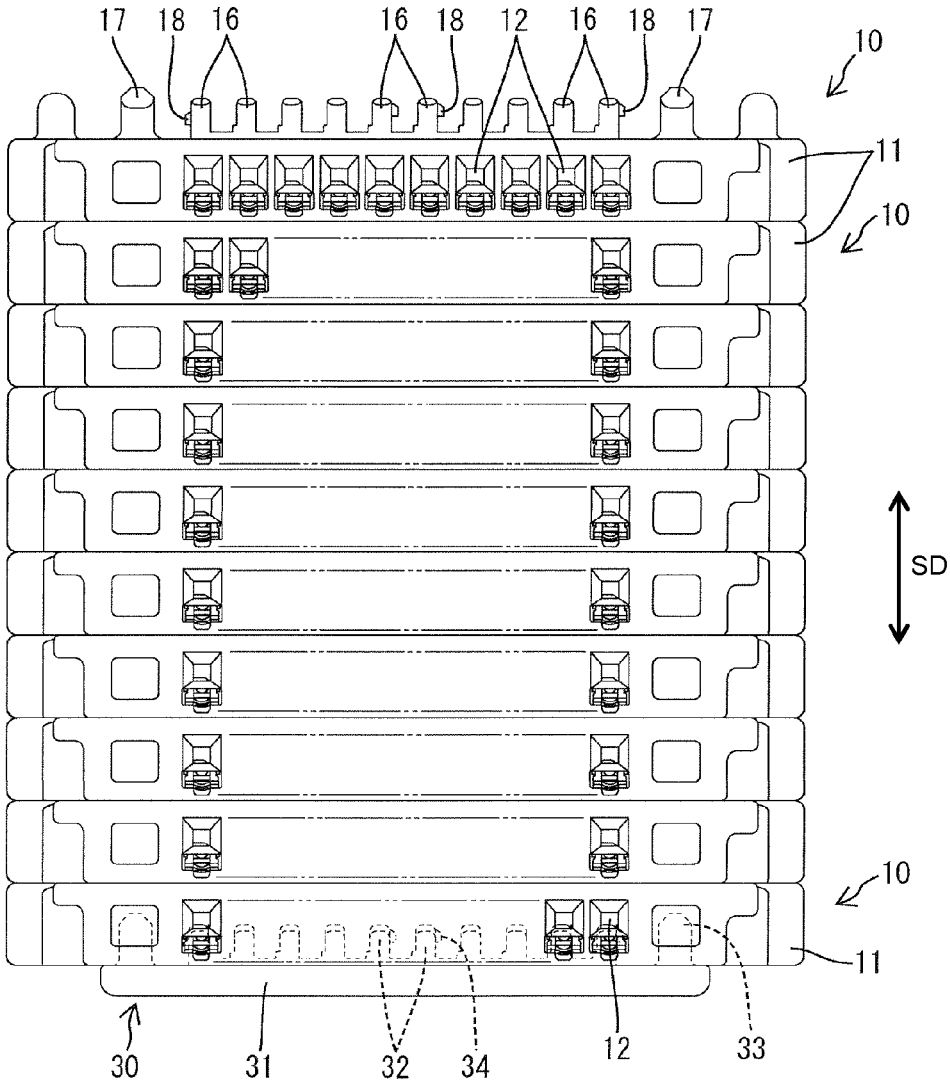
FIG. 1 is a front view of a plurality of assembled and stacked housings.

A connector in accordance with the invention is constructed by assembling two or more housings 10 and at least one retainer 30 while stacking them one above another. A stacking direction SD of the housings 10, an assembling direction of the housings 10, a stacking direction of the housings 10 and the retainer 30 and an assembling direction of the housings 10 and the retainer 30 all are vertical.

Each housing 10 is made e.g. of synthetic resin and includes at least one substantially bilaterally symmetric terminal accommodating portion 11, as shown in FIGS. 1, 2, 6 and 7. The terminal accommodating portion 11 is substantially a flat block whose dimension in forward and backward directions is smaller than the width and larger than the height. A plurality of terminal accommodating chambers 12 for receiving terminal fittings 20 are to be at least partly inserted (particularly substantially from behind) are formed substantially side by side in a lateral direction in the terminal accommodating portion 11 while being partitioned by partition walls. Terminal fittings 20 are inserted into the terminal accommodating chambers 12 from behind.

Figure 4:
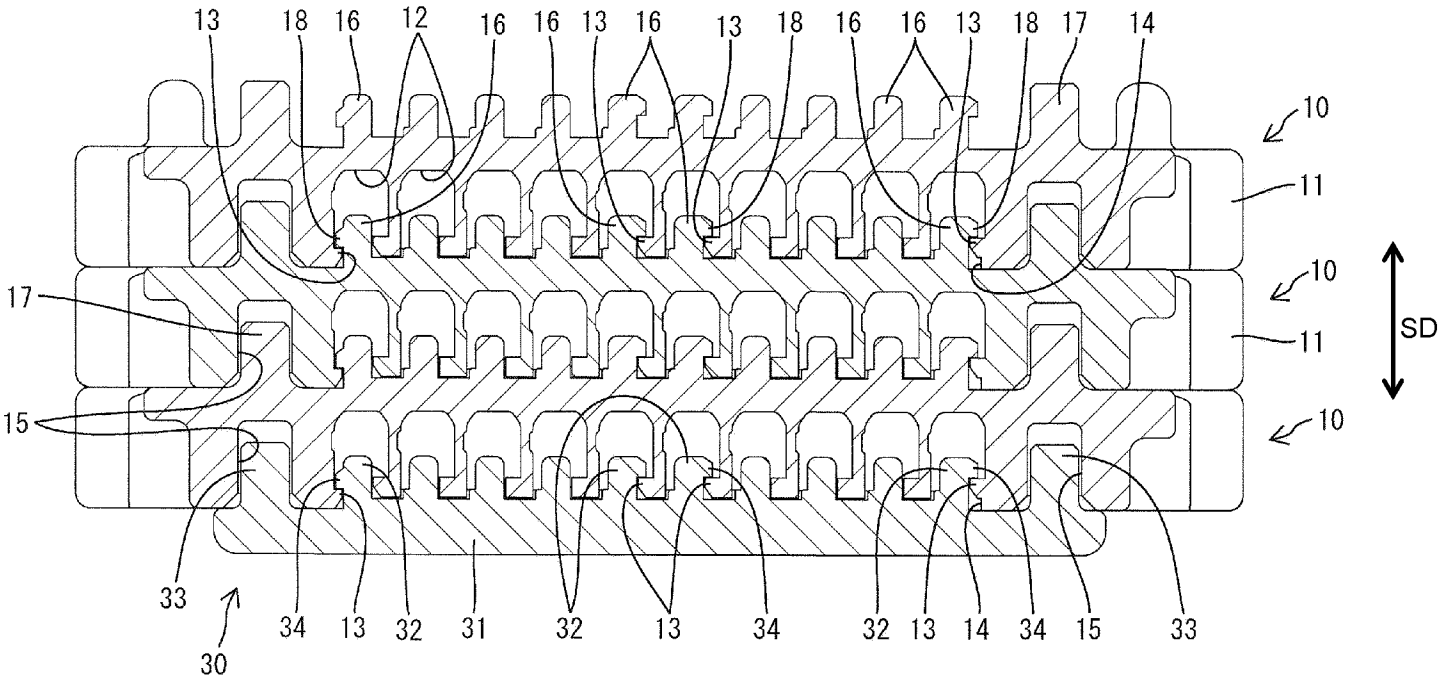
FIG. 4 is a section showing a structure for holding the housings in the stacked state.
Figure 5:
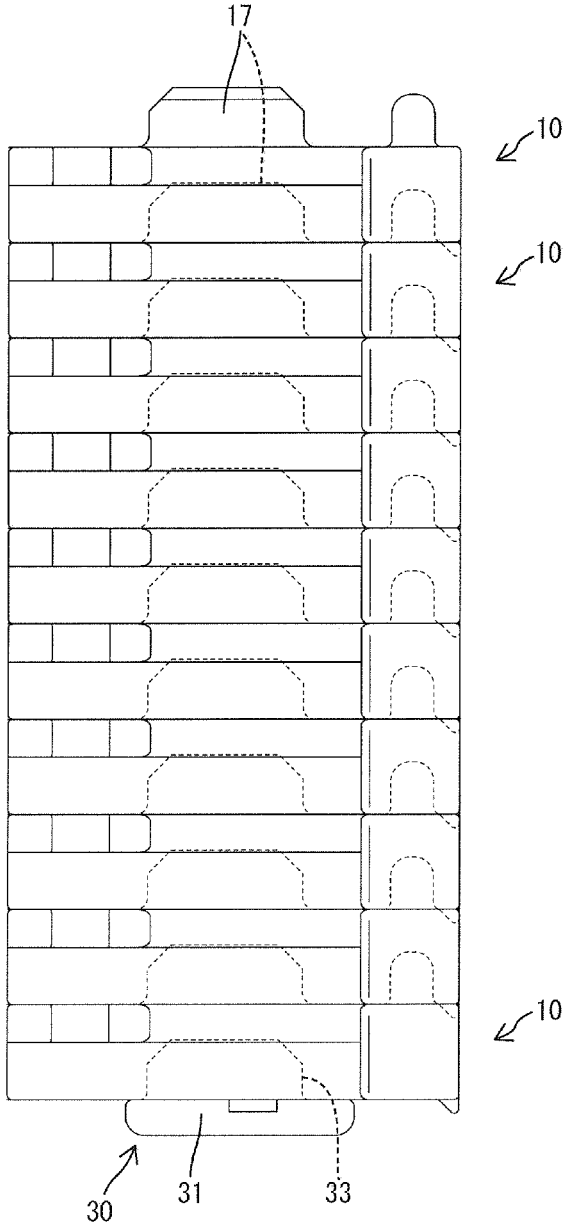
FIG. 5 is a side view showing the assembled and stacked housings.

As shown in FIG. 4, each of two terminal accommodating chambers 12 on the left and right ends and two terminal accommodating chambers 12 at lateral center positions are formed with receiving portions 13. Each receiving portion 13 is formed near the opening edge of a communication opening 14 in a lower surface of the terminal accommodating portion 11.

Figure 3:
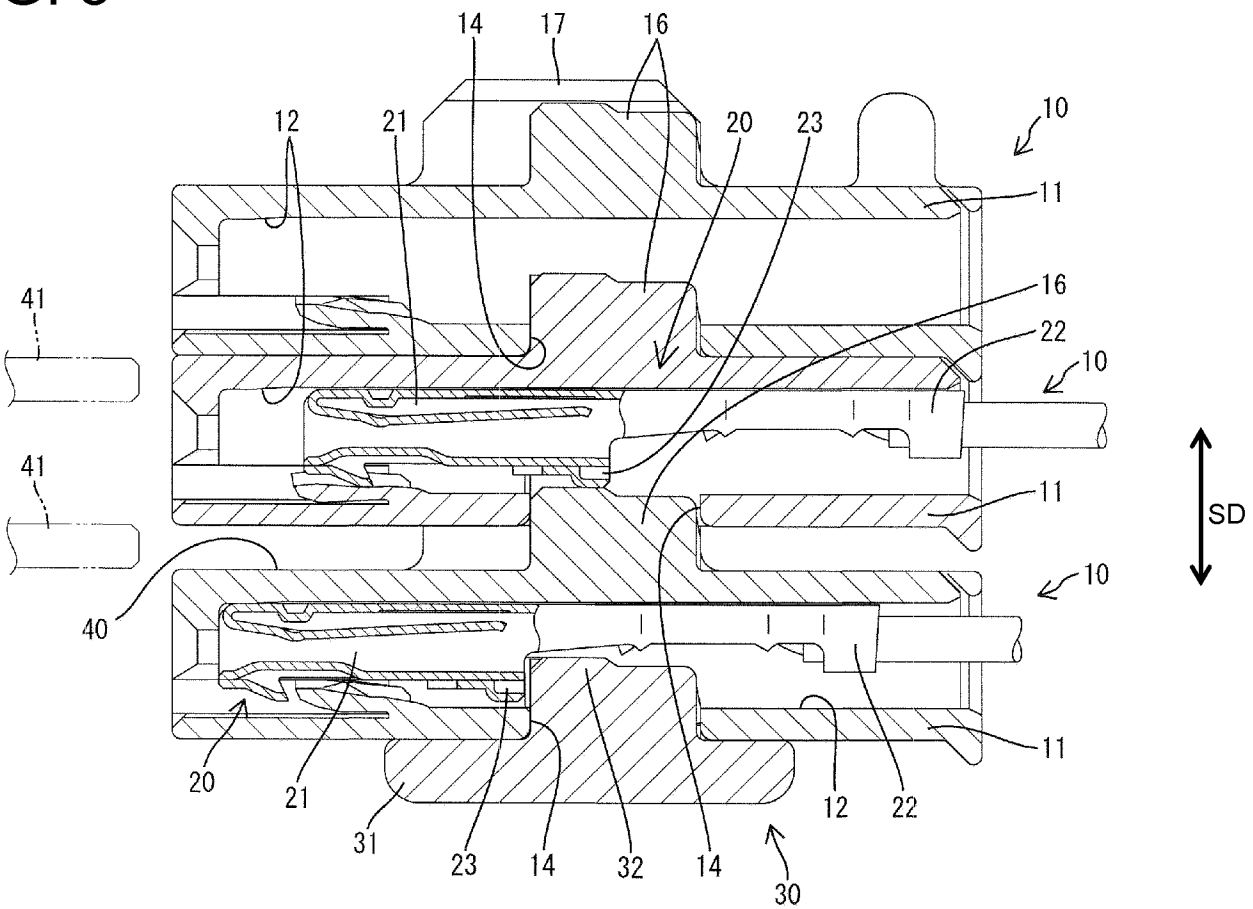
FIG. 3 is a section showing a stacked state of the housings.
Figure 11:
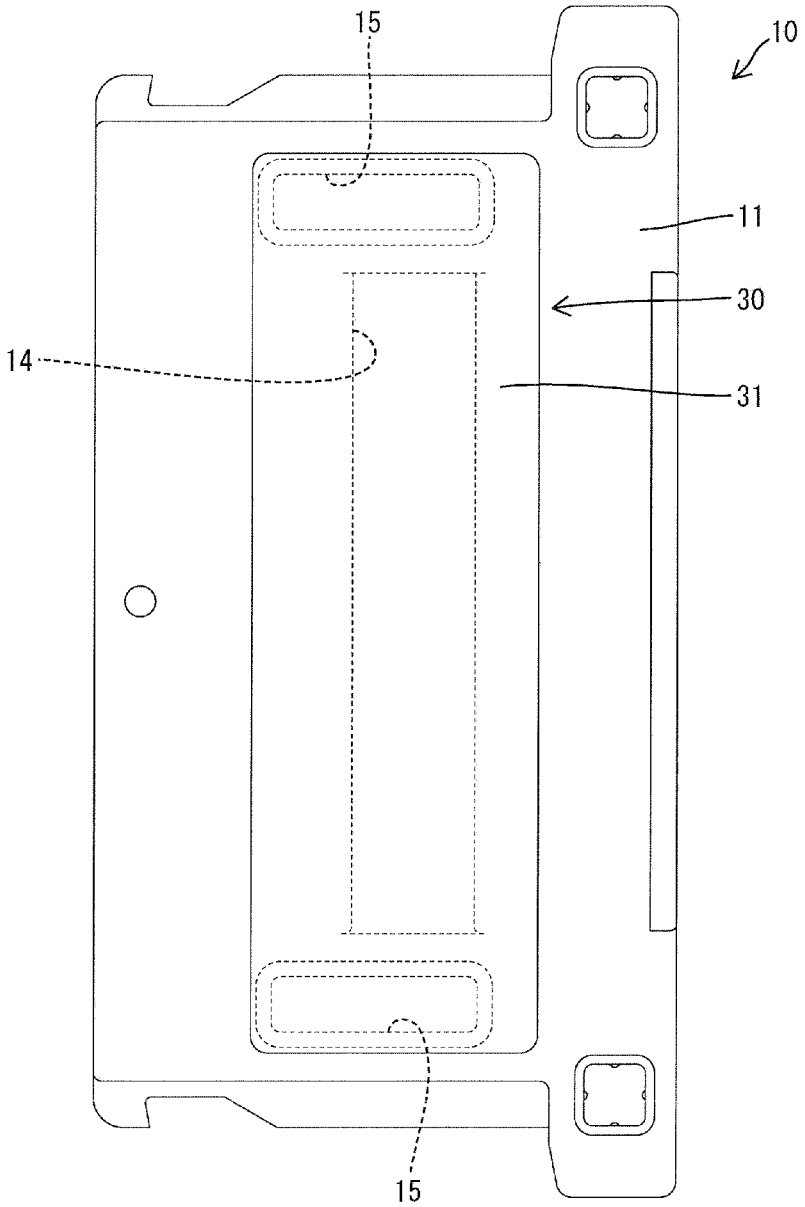
FIG. 11 is a bottom view showing a state where the retainer is mounted in the housing.

As shown in FIGS. 3, 4 and 11, each terminal accommodating portion 11 is formed with the communication opening 14 that opens to the outer surface and communicates with the terminal accommodating chambers 12. The communication opening 14 has a wide rectangular shape long so as to communicate with all of the terminal accommodating chambers 12. Similarly, the terminal accommodating portion 11 is formed with substantially bilaterally symmetric positioning holes 15 that open in the lower surface. The positioning holes 15 are arranged at the opposite sides of the communication opening 14.

Figure 2:
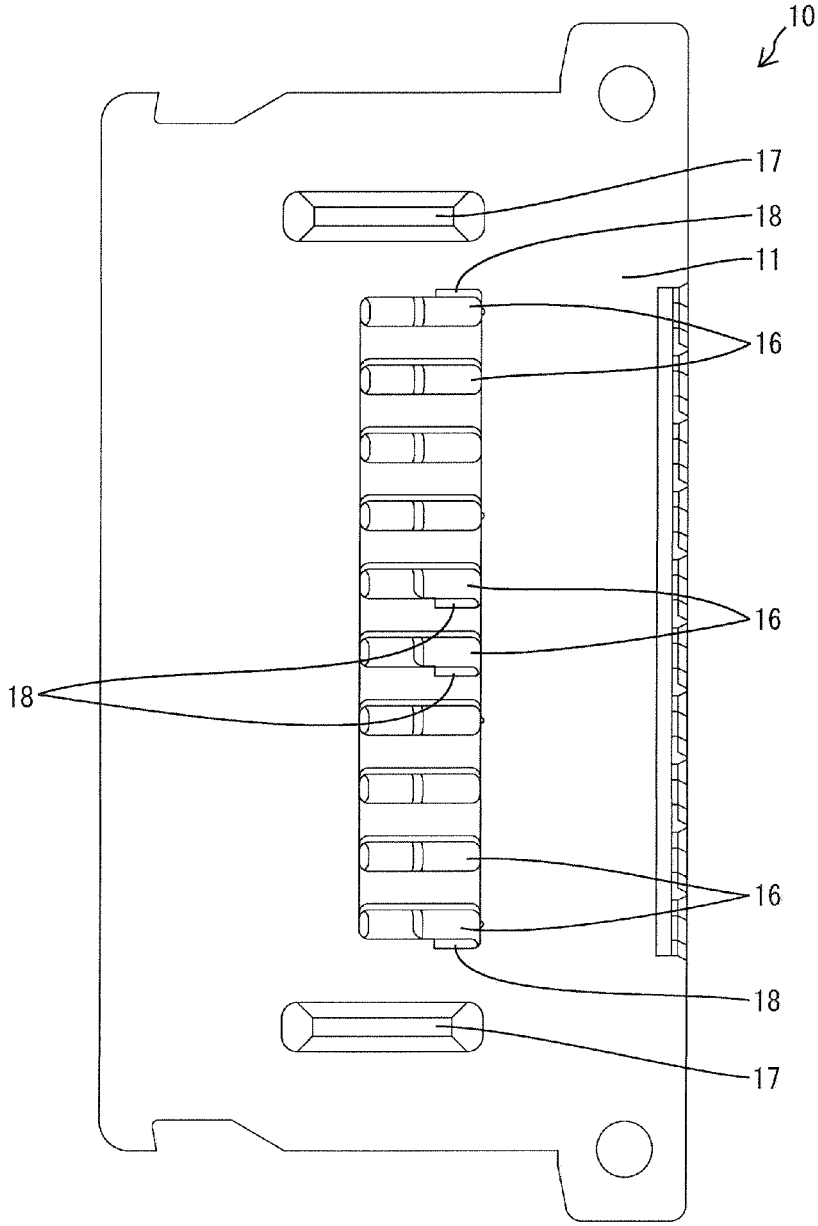
FIG. 2 is a plan view of the housing.

As shown in FIGS. 1, 2 and 4, each terminal accommodating portion 11 is formed with projections 16 projecting up at substantially right angles from the upper surface. The projections 16 are in the form of ribs extending in forward and backward directions and are arranged in the lateral direction to correspond to the respective terminal accommodating chambers 12. The projections 16 and the communication opening 14 are arranged substantially opposite each other in the vertical stacking direction SD of the housings 10. Similarly, two substantially bilaterally symmetric positioning projections 17 are formed to correspond to the positioning holes 15 on the upper surface of the terminal accommodating portion 11.

Figure 6:
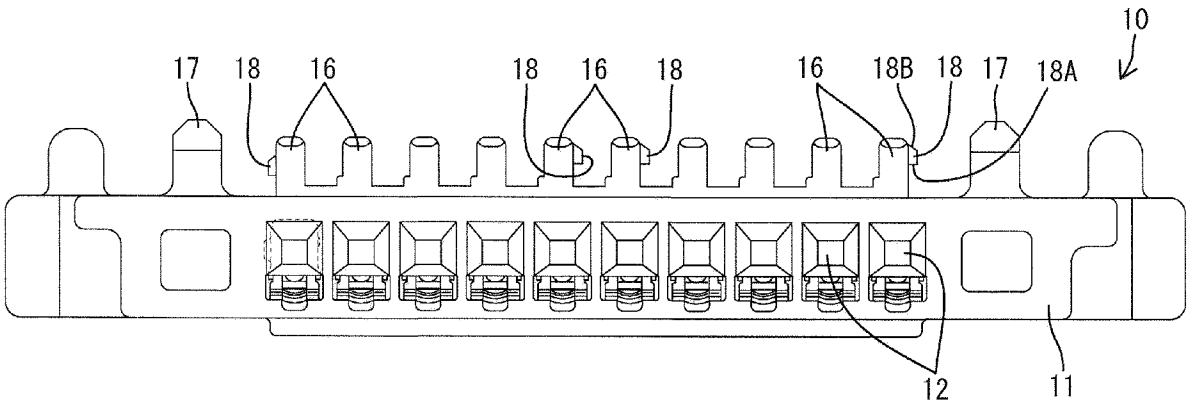
FIG. 6 is a front view of the housing.
Figure 7:
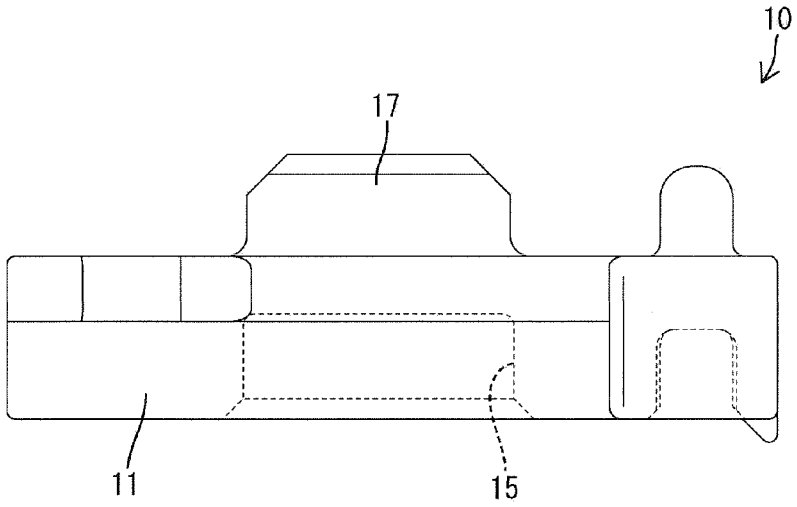
FIG. 7 is a side view of the housing.

As shown in FIGS. 2, 4 and 6, two projections 16 on the left and right ends and two projections 16 at substantially lateral center positions are formed with a lock 18 in the form of a projection. The lock 18 on the projection on the left end projects from the left surface of the projection 16, and the locking portion 18 formed on the projection 16 on the right end projects from the right surface of the projection 16. That is, the locking portions 18 on the left and right ends project in opposite directions. The locking portions 18 formed on the two center projections 16 project from the left surfaces (i.e. project in the same direction). As shown in FIG. 6, each of the locking portions 18 has a horizontal locking surface 18A facing down perpendicular to the assembling direction or stacking direction SD of the housing 10 and a guiding inclined surface 18B inclined with respect to the vertical assembling direction of the housing 10.

As shown in FIG. 3, each terminal fitting 20 is a female terminal of a known form and is long and narrow in forward and backward directions. A substantially rectangular tube 21 is formed at a front end of the terminal fitting 20, and a wire crimping portion 22 having a height smaller than the rectangular tube 21 is formed on a rear end of the terminal fitting 20. The upper surface of the rectangular tube 21 is substantially continuous and flush with the upper surface of the wire crimping portion 22. Hence, there is a height difference between the lower surfaces of the rectangular tube 21 and the wire crimping portion 22 to form a step. This height difference forms a retaining portion 23 on a lower edge of a rear end of the rectangular tube 21.

Figure 8:
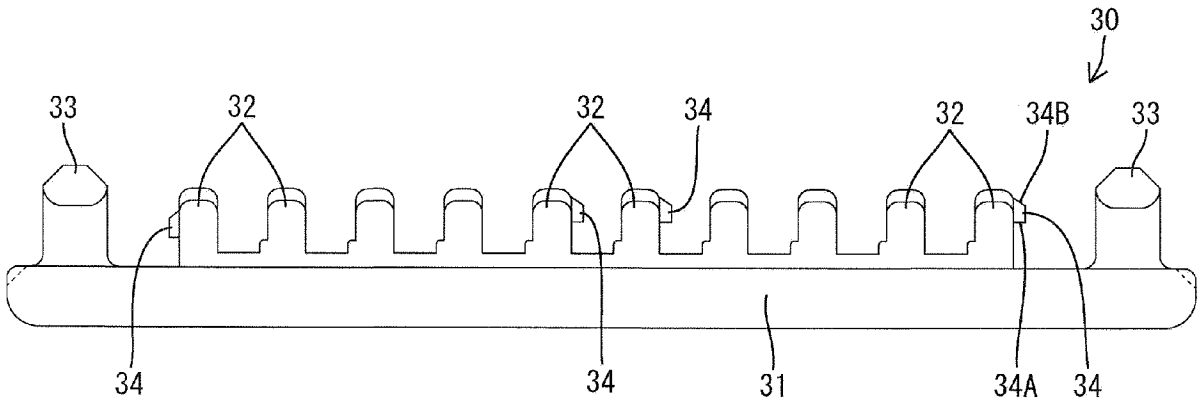
FIG. 8 is a front view of a retainer.
Figure 9:
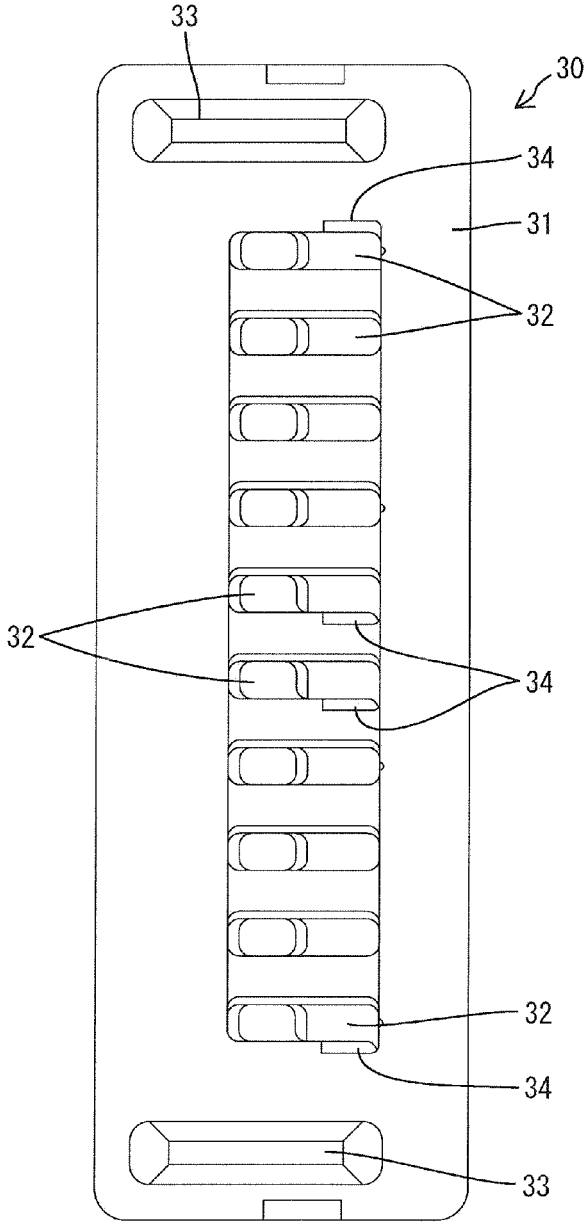
FIG. 9 is a plan view of the retainer.
Figure 10:
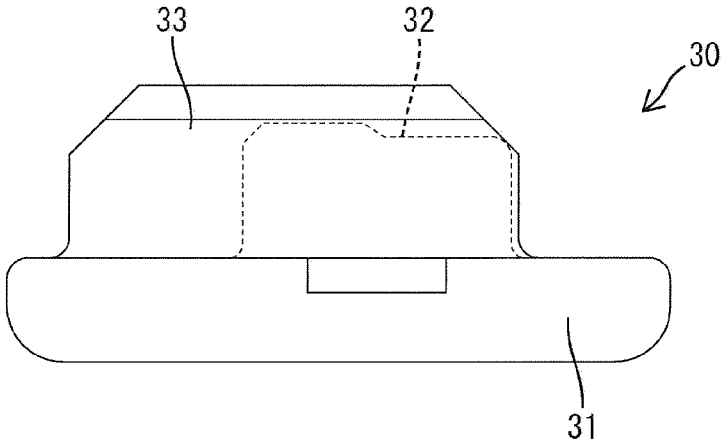
FIG. 10 is a side view of the retainer.

The retainer 30 is made of synthetic resin and, as shown in FIGS. 8 to 10, includes a wide substantially rectangular planar base 31. Projections 32 project up from the upper surface of the base 31, and left and right positioning projections 33 project up from the upper surface of the base 31. The base 31, the projections 32 and the positioning projections 33 are formed unitarily. As shown in FIG. 11, the base 31 is wider than the communication opening 14, and a dimension of the base 31 in forward and backward directions exceeds an opening dimension of the communication opening 14 in forward and backward directions. As shown in FIGS. 8 to 10, the projections 32 have the same shape and arrangement as the projections 16 formed on the housing 10, including the presence or absence of a lock 34 and the locking surface 34A and guiding inclined surface 34B on the lock 34. Further, the positioning projections 33 have the same shape and arrangement as the positioning projections 17 of the housing 10.

In assembling the housings 10 and the retainer 30, the terminal fittings 20 are inserted into the terminal accommodating chambers 12 of the separated housings 10 from behind and before the housings 10 and the retainer 30 are stacked. The terminal accommodating portions 11 of the housings 10 are assembled or stacked one above another along the stacking direction SD after all of the terminal fittings 20 have been inserted and the retainer 30 is assembled with the bottommost housing 10 in the stacking direction SD by placing the base 31 on the lower surface of the terminal accommodating portion 11 of the bottommost housing 10, as shown in FIGS. 1, 3 to 5. The respective positioning projections 17, 33 are fit into the positioning holes 15 so that the housings 10 and the retainer 30 are positioned horizontally with respect to forward and backward directions and the lateral direction.

The projections 16 of the lower housing 10 pass through the communication opening 14 of the upper housing 10 as the housings are assembled and enter the respective terminal accommodating chambers 12 to engage the retaining portions 23 of the terminal fittings 20 in the respective terminal accommodating chambers 12 from behind, as shown in FIGS. 3 and 4. Thus, the projections 16 retain the terminal fittings 20. Further, the retainer 30 is assembled to the bottommost housing 10. Thus, the projections 32 of the retainer 30 pass through the communication opening 14 and enter the terminal accommodating chambers 12 to engage the retaining portions 23 of the terminal fittings 20 in the respective terminal accommodating chambers 12 from behind. Thus, the projections 32 retain the terminal fittings 20.

If all the terminal fittings 20 are inserted properly, the housings 10 and the retainer 30 are stacked and assembled properly along the stacking direction SD) one above another. Thus, the lower surface of the upper housing 10 and the upper surface of the lower housing 10 are held substantially in surface contact and there are no large clearances between the housings 10. Further, there is no large clearance between the lower surface of the bottommost housing 10 and the upper surface of the base 31 of the retainer 30.

On the contrary, if any of the terminal fittings 20 is inserted insufficiently, the rear end of the rectangular tube 21 is in an entrance path for the projection 16, as shown in FIG. 3. Accordingly, the projection 16 contacts and interferes with the rectangular tube 21 of the insufficiently inserted terminal fitting 20 from below during the assembly. Thus, the assembling operation of the housings 10 is prevented. If there is any insufficiently inserted terminal fitting 20 in the bottommost housing 10 (not shown), the projection 32 of the retainer 30 interferes with the rectangular tube portion 21 during assembly of the retainer 30. Therefore the assembly of the housing 10 and the retainer 30 is prevented.

A clearance 40 is formed between the terminal accommodating portions 11 of the housings 10 and/or between the terminal accommodating portion 11 of the housing 10 and the base 31 of the retainer 30 if an insufficiently inserted terminal fitting 20 prevents the assembly of the housings 10 and/or of the housing 10 and the retainer 30. Thus, the locks 18, 34 and the receiving portions 13 of the housings 10 or the retainer 30 adjacent the clearance 40 are not engaged. As a result, the housings 10 and/or the retainer 30 adjacent the clearance 40 are vertically separable.

One or more detection jigs 41 are brought closer to the connector from the front to detect an assembled state. There are no clearances between the housings 10 and between the housing 10 and the retainer 30 if all the housings 10 and the retainer 30 are assembled properly. Thus, the detection jigs 41 contact the front end surfaces of the housings 10. In this way, it can be found that all of the terminal fittings 20 are inserted properly and the assembly of the housings 10 and the retainer 30 has been proper.

On the contrary, the clearance 40 is formed between the housings 10 or between the housing 10 and the retainer 30, as shown in FIG. 3, if any terminal fitting 20 is inserted insufficiently or if the assembly of the housings 10 or the retainer 30 has not been performed properly although the terminal fittings 20 are inserted properly. In this case, the detection jig 41 enters this clearance 40 to indicate that a terminal fitting 20 is not inserted sufficiently or that a housing 10 or the retainer 30 is not assembled properly.

As described above, each housing 10 of the connector includes the terminal accommodating chambers 12, the communication opening 14 in the outer surface and communicating with the terminal accommodating chambers 12 and the projections 16 projecting from the terminal accommodating portion 11. Additionally, the retainer 30 of the connector includes the base 31 and the projections 32 projecting from the base 31. Each housing 10 includes the receiving portions 13 and the locks 18 and the retainer 30 includes the locks 34. Accordingly, when the housings 10 are assembled, the receiving portions 13 of the upper housing 10 and the locks 18 of the lower housing 10 engage to hold the housings 10 in the assembled state. Further, when the housing 10 and the retainer 30 are assembled, the receiving portions 13 of the housing 10 and the locks 34 of the retaining portion 30 engaged to hold the housing 10 and the retainer 30 in the assembled state. Thus, the operator need not hold the housings 10 and the retainer 30 by hand to prevent separation after the housings 10 and the retainer 30 are stacked and assembled, and operability is excellent.

The present invention is not limited to the above described and illustrated embodiment. For example, the following embodiments are also included in the technical scope of the present invention.

Although the first and second members are the mutually identical housings in the above embodiment, they may be different members. That is, the present invention can be applied also when the first member is a housing as an exclusive means for accommodating the terminal fittings and the second member is a retainer as an exclusive means for retaining the terminal fittings in the first member.

In the above embodiment, a clearance is formed between the first and second members only when the first and second members are assembled incompletely. However, a clearance narrower than that at the time of incomplete assembling may be formed even when the two members are assembled properly.

In the above embodiment, a clearance is formed between the first and second member when the two members are assembled incompletely. However, no clearance member may be formed between the two members when the two members are incompletely assembled.

Although the number of the projections is set at ten in the above embodiment, it may be any number.

Although the lock is formed on either the left or right surface of the projection in the above embodiment, it may be formed on the front or rear surface of the projection.

Although one locking is formed on one projection in the above embodiment, a plurality of locks may be formed on one projection.

Although the locks are formed on the projections located on the left and right ends and on the two projections located in the center, the locks may be formed on the projections arranged at other positions.

Although the locks are projections in the above embodiment, they may be in the form of recesses formed in the outer surfaces of the projections.

Although the above embodiment has been described with respect to a housing in which one or more female terminal fittings are to be accommodated, it should be understood that the invention is equally applicable to a housing in which one or more male terminal fittings are to be accommodated.

What is claimed is:

1. A connector, comprising:

a first member including at least one terminal accommodating chamber, at least one communication opening formed in an outer surface and communicating with the terminal accommodating chamber and at least one receiving portion in proximity to the communication opening; and a second member including a base configured to be placed on the outer surface of the first member, at least one projection projecting from the base, the projection being insertable through the communication opening and into the terminal accommodating chamber to engage a terminal fitting accommodated at a proper position in the terminal accommodating chamber and to retain the terminal fitting at the proper position when the base is placed on the outer surface of the first member, the projection including at least one lock for engaging the receiving portion and holding the first and second members in an assembled state, wherein a clearance is formed between the first and second members at a front end of the connector when the terminal fitting is at an improper position in the terminal accommodating chamber, the clearance being open in a direction crossing an assembling direction.

2. The connector of claim 1, wherein the first and second members are identical housings.

3. The connector of claim 2, wherein each of the housings includes the terminal accommodating chamber, the communication opening, the projection, the receiving portion and the lock.

4. The connector of claim 2, wherein a plurality of the housings and a retainer are stacked in a stacking direction.

5. The connector of claim 1, wherein the outer surface of the first member and a substantially facing surface of the second member are substantially in surface contact when the first and second members are assembled properly.

6. The connector of claim 1, further comprising:

at least one detection jig configured to be inserted into the clearance when the terminal fitting is in an improper position in the terminal accommodating chamber.

7. A connector, comprising:

a first member including at least one terminal accommodating chamber, at least one communication opening formed in an outer surface and communicating with the terminal accommodating chamber and at least one receiving portion in proximity to the communication opening;

a terminal fitting in the terminal accommodating chamber; and a second member including a base configured to be placed on the outer surface of the first member, at least one projection projecting from the base, the projection being insertable through the communication opening and into the terminal accommodating chamber to engage the terminal fitting in the terminal accommodating chamber and to retain the terminal fitting when the base is placed on the outer surface of the first member, the projection including at least one lock engaging the receiving portion and holding the first and second members in an assembled state, wherein the projection is configured to interfere with the terminal fitting in an improper position in the terminal accommodating chamber to prevent complete assembly of the first and second members, and a clearance is formed between the first and second members when the terminal fitting is at an improper position in the terminal accommodating chamber, the clearance being open in a direction crossing an assembling direction.

8. The connector of claim 7, wherein a portion of the terminal fitting that has been inserted improperly into the terminal accommodating chamber is located in an entrance path for the projection.

9. The connector of claim 7, further comprising:

at least one detection jig configured to be inserted into the clearance when the terminal fitting is in an improper position in the terminal accommodating chamber.

10. A connector, comprising a plurality of identical housings, each of the housings including terminal accommodating chambers, terminal fittings accommodated respectively in the terminal accommodating chambers, each housing including opposite first and second outer surfaces, a communication opening formed in the first outer surface of each of the housings and communicating respectively with the terminal accommodating chambers and at least one receiving portion in proximity to the communication opening, projections projecting from the second outer surface of each of the housings, the projections being disposed and configured for insertion through the communication opening and into the respective terminal accommodating chamber when the second outer surface of one of the housings is placed on the first outer surface of another of the housings, the projections being configured to engage and retain the terminal fitting that has been inserted properly into the respective terminal accommodating chamber, at least one of the projections including a lock engaging the receiving portion and holding the housings in an assembled state, wherein each projections is configured to interfere with the respective terminal fitting in an improper position in the terminal accommodating chamber to prevent complete assembly of the housings, and a clearance is formed between the housings of the plurality of identical housings when the terminal fitting is at an improper position in the terminal accommodating chamber, the clearance being open in a direction crossing an assembling direction.

11. The connector of claim 10, wherein a portion of one of the terminal fittings that has been inserted improperly into the respective terminal accommodating chamber is located in an entrance path for the projection.

12. The connector of claim 10, further comprising a retainer mounted to one of the housings, the retainer having projections insertable into the respective communication openings, the projections being configured to engage and retain the terminal fitting that has been inserted properly into the respective terminal accommodating chamber, at least one of the projections including a lock engaging the receiving portion and holding the retainer in an assembled state with the housings.

13. The connector of claim 10, further comprising:

at least one detection jig configured to be inserted into the clearance when the terminal fitting is in an improper position in the terminal accommodating chamber.

* * * * *